US009380372B2

(12) United States Patent
Pettersen et al.

(10) Patent No.: US 9,380,372 B2
(45) Date of Patent: Jun. 28, 2016

(54) WATERPROOF CONTROLLER FOR AUDIO HEADSETS

(71) Applicant: INCIPIO, LLC, Irvine, CA (US)

(72) Inventors: Carl Pettersen, San Diego, CA (US); Peter Dirksing, San Diego, CA (US)

(73) Assignee: Incipio, LLC, Irvine, CA (US)

( * ) Notice: Subject to any disclaimer, the term of this patent is extended or adjusted under 35 U.S.C. 154(b) by 278 days.

(21) Appl. No.: 13/793,963

(22) Filed: Mar. 11, 2013

(65) Prior Publication Data

US 2014/0254848 A1 Sep. 11, 2014

(51) Int. Cl.
*H04R 1/02* (2006.01)
*H04R 1/10* (2006.01)

(52) U.S. Cl.
CPC ..... *H04R 1/1041* (2013.01)

(58) Field of Classification Search
CPC ..... H04R 1/02; H04R 1/028; H04R 1/1033; H04R 5/033; H04R 2499/11; H04R 2420/07; H04R 1/023; H04R 1/025
USPC ..... 381/334, 384
See application file for complete search history.

(56) References Cited

U.S. PATENT DOCUMENTS

2009/0017884 A1* 1/2009 Rotschild ..... H04M 1/18 455/575.8
2010/0006314 A1* 1/2010 Wilson et al. ..... 174/50.5
2011/0017620 A1* 1/2011 Latchford et al. ..... 206/320
2011/0110553 A1* 5/2011 Logan ..... 381/380
2013/0301864 A1* 11/2013 Glaser ..... H04R 1/1033 381/380
2014/0105443 A1* 4/2014 Kennerly et al. ..... 381/384

OTHER PUBLICATIONS

David Carnoy, "Monster iSport Immersion review: Headphones for athletes", printed from web Jan. 29, 2016, http://www.cnet.com/products/monster-isport-series/.

* cited by examiner

*Primary Examiner* — Rasha Al Aubaidi
(74) *Attorney, Agent, or Firm* — Manatt, Phelps & Phillips, LLP

(57) ABSTRACT

Disclosed herein are inline waterproof controllers for electronic devices. The waterproof inline controllers can house and protect a remote controller from damage. The waterproof inline controllers can allow for a user to remotely operate an audio device while the user is exercising or engaged in watersports. The waterproof inline controllers may further include a microphone or speaker. A method of making the waterproof inline controllers provides a cost effective and efficient means of manufacture.

22 Claims, 18 Drawing Sheets

WATERPROOF CONTROLLER FOR AUDIO HEADSETS

BACKGROUND

1. Field

The present disclosure relates waterproof control devices, and more specifically, to inline waterproof controllers for audio headsets configured to control the operation an electronic device coupled to a headset.

2. Description of the Related Art

In general, headphones or headsets include a communication link that transmits a signal from a signal source to a device configured to generate audible sounds. Often times, this communication link comprises an insulated audio wire having one end configured to be connected to a portable media player and at least one other end coupled to a small loudspeaker such as an earphone or earbud. In some instances, the headphones or headsets include an inline controller configured to control the operation of the signal source.

SUMMARY

The devices, systems, and methods of the present disclosure have several features, no single one of which is solely responsible for its desirable attributes. Without limiting the scope of this invention as expressed by the claims which follow, its more prominent features will now be discussed briefly. After considering this discussion, and particularly after reading the section entitled "Detailed Description of Certain Embodiments," one will understand how the features of this disclosure provide several advantages over other headsets.

One aspect is an audio headset that may comprise FILL When Claims are Final.

BRIEF DESCRIPTION OF THE DRAWINGS

These and other features, aspects, and advantages of the invention disclosed herein are described below with reference to the drawings of certain embodiments, which are intended to illustrate and not to limit the invention. Additionally, from figure to figure, the same reference numerals have been used to designate the same components of an illustrated embodiment. The following is a brief description of each of the drawings.

DETAILED DESCRIPTION OF CERTAIN EMBODIMENTS

Figure 1:
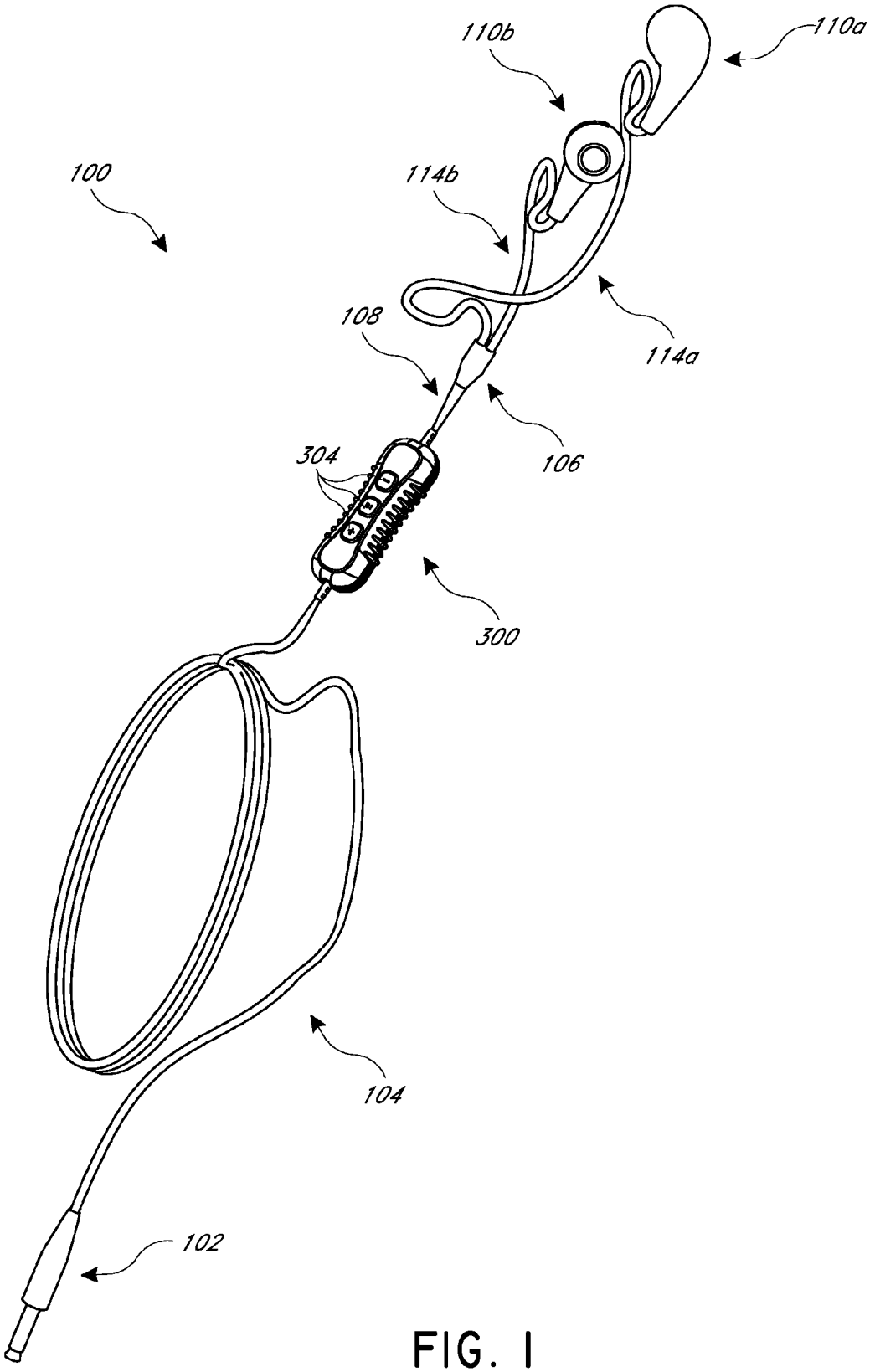
FIG. 1 is a perspective view of a waterproof headset including a waterproof inline controller according to one embodiment.

The following description and examples illustrate preferred embodiments of a waterproof controller in the context of use with an exemplary headset. More specifically, the embodiments disclosed herein relate to a waterproof controller that can operate an electronic device such as an iPhone® or iPod®. In some embodiments, the controller also includes a microphone.

While the illustrated embodiments of the waterproof controllers are shown in use with a headset that includes an audio connector and two earbuds, there are several possible configurations that the disclosed embodiments can take to include the various aspects and features described herein. Thus, the illustrations of the controller in this particular context is not intended to limit the disclosed aspects and features to the specified embodiment or to usage only with the illustrated headset. For example, the disclosed embodiments can be used with a headset that includes a microphone and one or more sound generating device(s) and the audio connector and sound generating devices may be any suitable device or configuration known in the art. Those of skill in the art will recognize that the disclosed aspects and features are not limited to any particular embodiment of a controller and systems and/or devices including a controller, which may include one or more of the inventive aspects and features herein described, can be designed for use in a variety of implementations.

It will be understood by those of skill in the art in view of the present disclosure that the waterproof controllers described herein can be used in connection with various devices including, but not limited to, portable audio players, mobile telephones, portable videogame devices, personal digital assistants, tablets, and other consumer electronic devices. The cords that are coupled to the controllers may also be configured transmit and receive signals other than, or in addition to, audio signals. The waterproof controllers may also be used with water resistant, waterproof, or SCUBA capable headsets.

Waterproof controllers disclosed herein can allow for a user to operate a portable electronic device while enjoying watersports such as swimming, snorkeling, surfing, and the like. The waterproof controllers can increase the lifespan of the headset and protect water sensitive components from damage or wear caused by sweat or other moisture. The portable electronic device may be waterproof or enclosed in a waterproof case and the controls may not be easily accessible. The controller may be located on the cord leading from the electronic device to the audio output source. The waterproof controller can allow for an electronic device to be powered on or off, or can be utilized to adjust the volume, answer a phone call, play, stop, and skip audio tracks, and or configured to start and stop various functions performed by the electronic device while the controller is submerged under water.

As used herein, "waterproof" means that the device referred to as "waterproof" is capable of being completely submerged under water for a substantial period of time without water penetrating a "waterproof" barrier and/or "waterproof" seal. The substantial period of time may include 30 seconds, 1 minute, 1 hour, or greater than 1 hour.

As used herein, "SCUBA capable" means able to withstand pressures experienced by a SCUBA diver, for example, pressures at underwater depths between about 10 and 300 feet. For example, features of the waterproof controllers described herein can be incorporated into headsets described in U.S. Pat. No. 7,263,032, which is incorporated by reference in its entirety, or with other waterproof headsets, headphones, and/or earbuds known in the art. In some embodiments, the cords and/or earbuds may be configured to float in water.

Also, the terms "proximal" and "distal," are consistently used herein with "proximal" referring to an end of a device closer to the point of attachment to an electronic device and "distal" referring an end that is opposite of "proximal."

Various aspects will now be described with reference to specific forms or embodiments selected for the purposes of illustration. It will be appreciated that the spirit and scope of the controllers disclosed herein is not limited to the selected forms. Moreover, it is to be noted that the figures provided herein are not drawn to any particular proportion or scale, and that many variations can be made to the illustrated embodiments.

With reference to FIG. 1, the illustrated headset 100 includes a connector 102, coupled to a first main cord 104, a waterproof controller 300, a second main cord 108, a splitter 106, and left and right cords 114*a* and 114*b* coupled respectively to left and right earbud speakers 110*a* and 110*b*.

The connector 102 can be any suitable connector. For example, the connector 102 typically includes three contacts that can communicate with an electronic device when the connector 102 is coupled to the electronic device but, the connector 102 can include more or less contacts depending on the device that the connector 102 is configured to be used with. Each contact can be coupled to one or more wires configured to transmit an electronic signal. The wires may be insulated. The first main cord 104 can be any suitable length.

The connector 102 can be coupled to the first main cord 104. The main cord 104 can include one or more lumens having one or more wires configured to transmit an electronic signal passing through said lumens. The main cord can be made of a flexible insulating material such as rubber or flexible plastic.

Continuing with FIG. 1, the first main cord 104 may be coupled to a waterproof controller 300. As shown, the waterproof controller 300 includes an oblong rectangle shaped container having rounded corners having a proximal end and a distal end. The first main cord 104 is coupled to the proximal end of the waterproof controller 300.

The waterproof controller includes three buttons 304 configured to be depressed by a user's fingers. The waterproof controller 300 can be configured to control an electronic device that is coupled to the connector 102. For example, the waterproof controller 300 can include one or more buttons or other similar controls to allow a user to adjust for example the audio volume, advance, pause, or play a song, answer a phone, etc. The waterproof controller 300 may or may not include a microphone. One of skill in the art will appreciate that more or less buttons may be included depending on the application of the particular device that the waterproof controller 300 is configured to be compatible with.

A second main cord 108 is coupled to the distal end of the waterproof controller 300. The second main cord 106 splits into left and right cords 114*a* and 114*b* at splitter 106. The splitter 106 is generally made of hard plastic so as to prevent fraying or damage to second main cord 106 at the split. The distal ends of the left and right cords 114*a* and 114*b* are coupled to left and right earbuds 110*a* and 110*b*. The earbuds may be waterproof.

Figure 2:
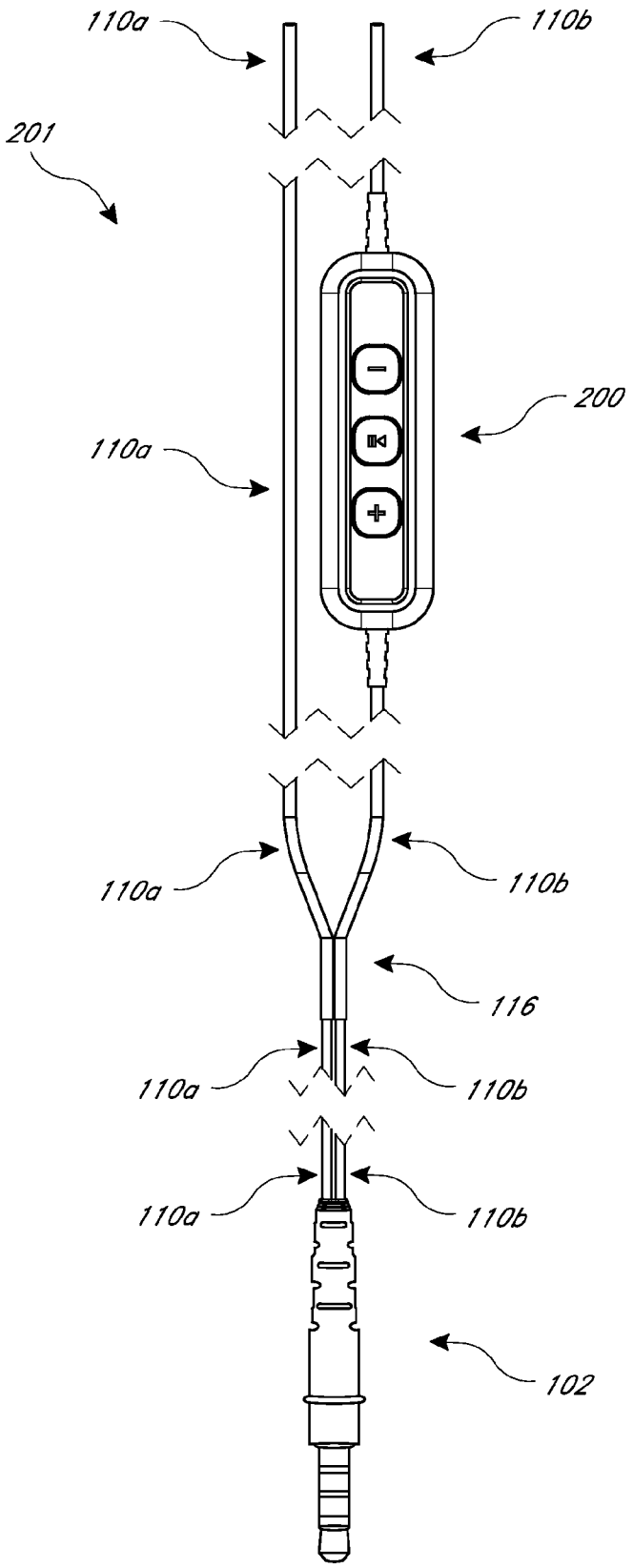
FIG. 2 is partial front view of a waterproof headset including a waterproof inline controller according to another embodiment.

FIG. 2 is partial front view of a waterproof headset 201 including a waterproof inline controller 200 according to another embodiment. As shown, the illustrated headset 201 includes a connector 102, coupled to the left cord 110*a* and the right proximate cord 110*b*, a splitter 116, and a waterproof inline controller 200 coupled to the right proximate cord 110*b* and the right distal cord 110*c*.

Figure 3:
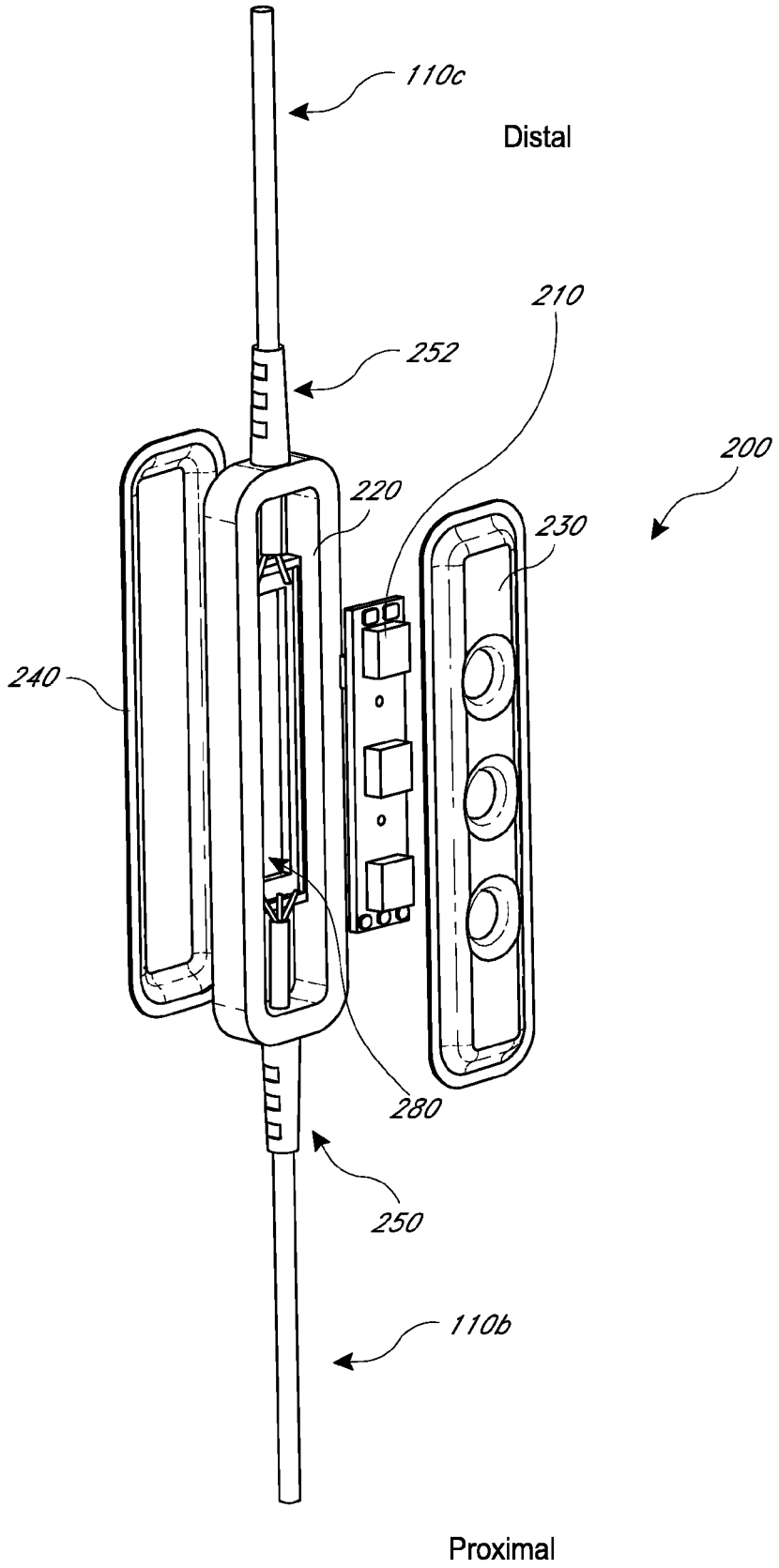
FIG. 3 is an exploded view of the waterproof inline controller shown in FIG. 2.

Turning to FIG. 3, an exploded view of the waterproof inline controller 200 coupled to proximate right cord 110*b* and right distal cord 110*c* and illustrates a remote 210 disposed within a rigid frame 220. A front cover 230 and a back cover 240 can be sealed to the rigid frame 220 to enclose the remote 210. As shown, the rigid frame 220 is roughly shaped as an elongated rectangle having a proximal end, a distal end, and opposing sides. In some embodiments, a waterproof seal is used to seal the front cover 230 and the back cover 240 together.

The rigid frame 220 may further include a receiving space 280 shaped and sized to receive the remote 210. The receiving space 280 may include one or more abutment surface to help restrain the remote within the rigid frame 220. The remote 210 may be secured in a fixed position within the rigid frame 220 by other techniques known in the art. In some embodiments an adhesive is used to secure the remote 210 within the rigid frame 220. The rigid frame may be formed of a hard plastic. In some embodiments, the rigid frame comprises polyurethane having a hardness between 85A and 95A. In some embodiments, the polyurethane has a hardness of about 90A.

Continuing with FIG. 3, the proximate right cord 110*b* may enter through an opening in the proximal end of the rigid frame 220 and the distal right cord 110*c* may enter through an opening in the distal end of the rigid frame 220. In some embodiments, the rigid frame 220 is formed around the proximate right cord 110*b* and the distal right cord 110*c*. The interface between the proximate right cord 110*b* and the rigid frame 220 and the distal right cord 110*c* and the rigid frame 220 can form a waterproof seal. As shown in FIG. 3, a proximal and a distal over-mold 250 and 252 may be formed over a portion of the proximate right cord 110*b* distal right cord 110*c* to further ensure that water does not enter the interior of the rigid frame 220 housing the remote 210.

The remote 210 may be configured to control the operation of an iPhone® or iPod® device. In some embodiments, the remote 210 includes three proximal leads and two distal leads. The remote 210 may include three buttons on the front side of the remote 210 and a microphone on the back side of the remote 210. In some embodiments, the remote 210 includes a printed circuit board assembly.

The front cover 230 and back cover 240 may comprise a thin flexible sheet of plastic such as polyurethane. In some embodiments, the front cover 230 and back cover 240 have a thickness of about 0.2 mm. In some embodiments, the front cover 230 and/or back cover 240 may be configured such that sound may pass through the front cover 230 and/or back cover 240 without significant distortion. In this way, a remote having a microphone and/or speaker may be housed within the device.

As shown in FIG. 3, the front cover 230 may include three depressions shaped to receive the three buttons of the remote 210. The front cover 230 may comprise a single sheet of thin plastic without any openings. The front cover 230 and back cover 240 are waterproofably sealed to the rigid frame 220. In some embodiments, radio frequency welding is used to form a waterproof seal between the covers and the rigid frame 220. IN this way, the buttons are protected from water.

Figure 4:
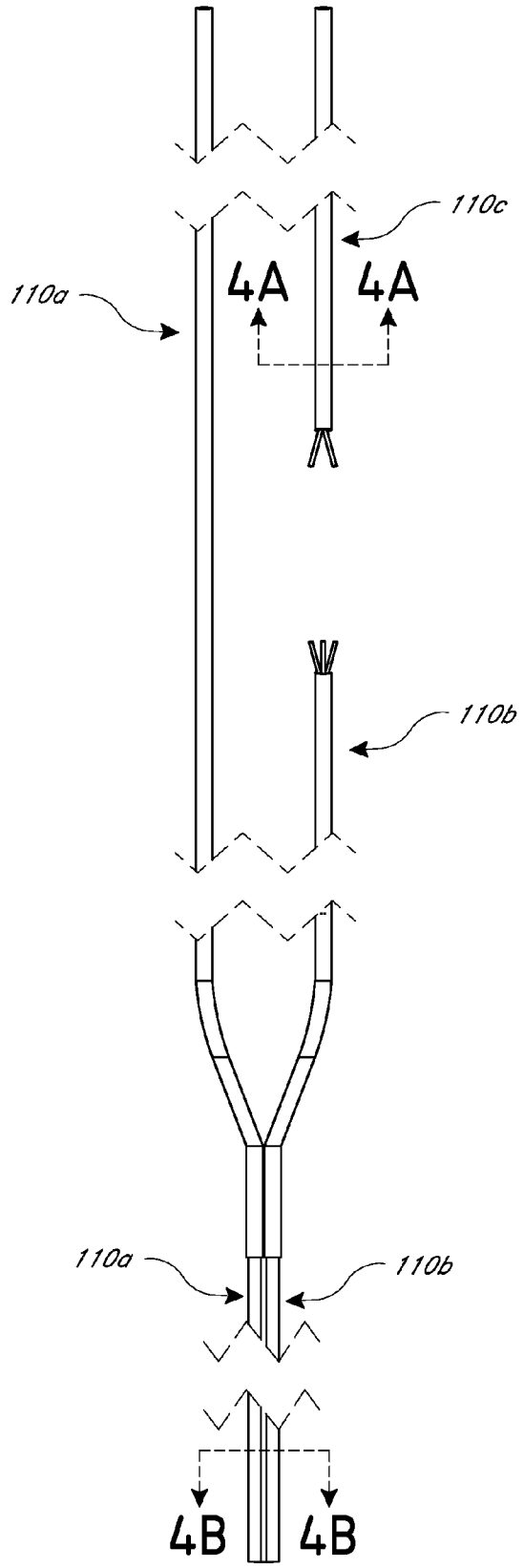
FIG. 4 is a partial front view of a waterproof headset with the waterproof inline controller removed.
Figure 4A:
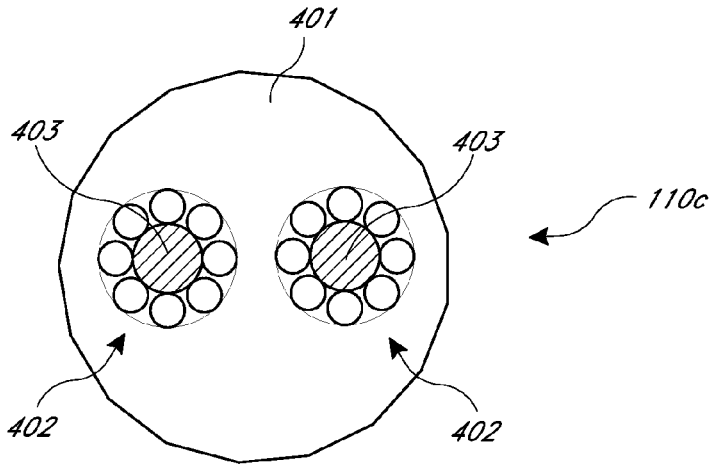
FIG. 4A is cross-sectional view of the cord show in FIG. 4 taken about the line 4A-4A.
Figure 4B:
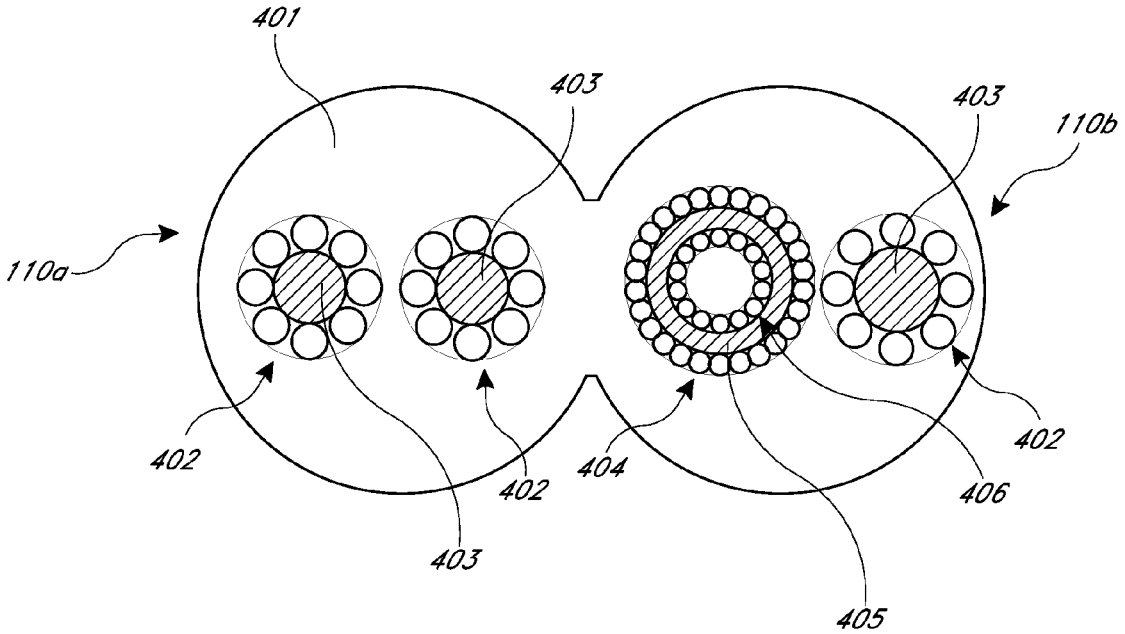
FIG. 4B is cross-sectional view of the cords show in FIG. 4 taken about the line 4B-4B.

With reference to FIGS. 4, 4A, and 4B, the internal wiring of the audio cords according to one embodiment is detailed. As shown in FIGS. 4A and 4B the left cord 110*a* and distal right cord 110*c* include two sets of insulated copper wiring 402 disposed about two supports 403 and encased in polyurethane 401. In the illustrated embodiment, eight strands of enameled copper wiring having a diameter of about 0.08 mm surround each support 403. The support 403 may comprise a high strength material such as silk or Kevlar. In some embodiments, the cords 110*a*-110*c* have a breaking strength of greater than ten pounds.

With reference to FIG. 4B, proximate right cord 110*b*, coupled to the connector and the remote, includes one set of insulated copper wiring 402 disposed about one support 403 and encased in polyurethane 401. The proximate right cord 110*b* further includes twenty-five strands of insulated copper wiring 404 having a diameter of about 0.06 mm and fourteen strands of enameled copper wiring 406 having a diameter of about 0.08 mm separated by an insulating layer 405. The insulating layer may comprise polyurethane or thermoplastic polyurethane.

Figure 5C:
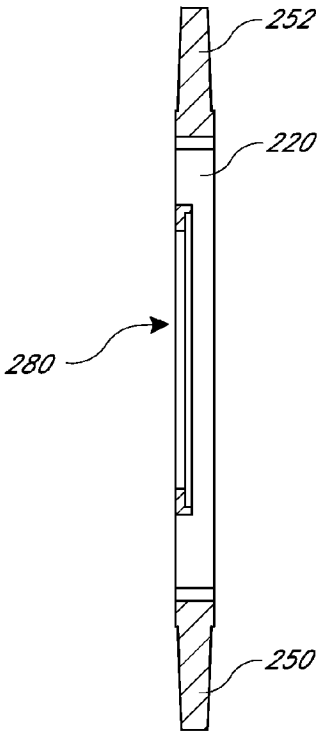
FIG. 5C is a cross-sectional view of the rigid frame of the waterproof inline controller shown in FIG. 5B taken about the line 5C-5C.
Figure 5B:
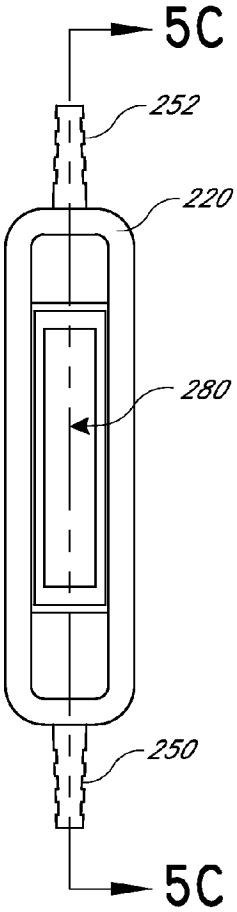
FIG. 5B is a front view of the rigid frame of the waterproof inline controller shown in FIGS. 3 and 5A.
Figure 5A:
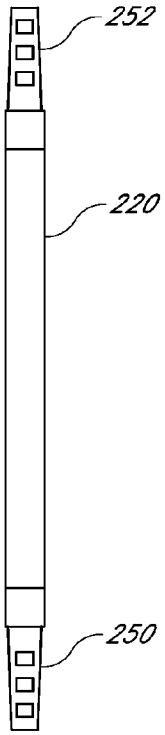
FIG. 5A is a side view of a rigid frame of the waterproof inline controller shown in FIG. 3.
Figure 6C:
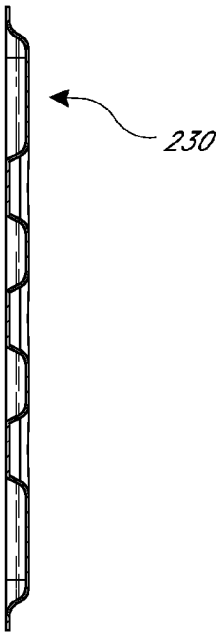
FIG. 6C is a cross-sectional view of the front member of the waterproof inline controller shown in FIG. 6B taken about the line 6C-6C.
Figure 6B:
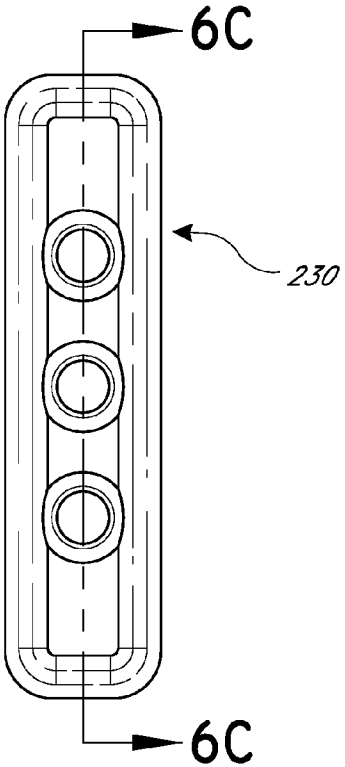
FIG. 6B is a front view of the front member of the waterproof inline controller shown in FIGS. 3 and 6A.
Figure 6A:
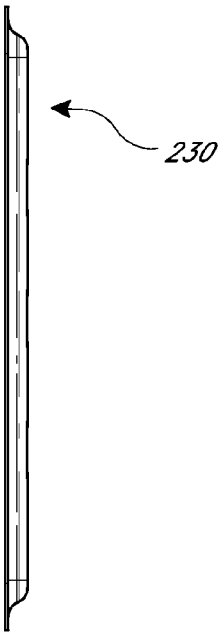
FIG. 6A is a side view of a front member of the waterproof inline controller shown in FIG. 3.
Figure 7C:
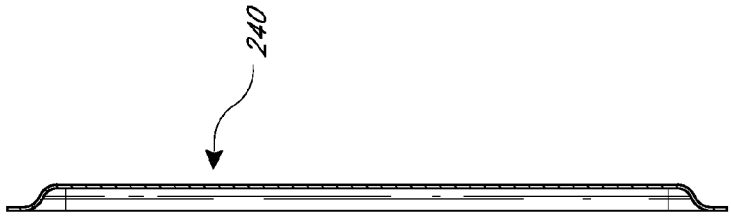
FIG. 7C is a cross-sectional view of the back member of the waterproof inline controller shown in FIG. 7B taken about the line 7C-7C.
Figure 7B:
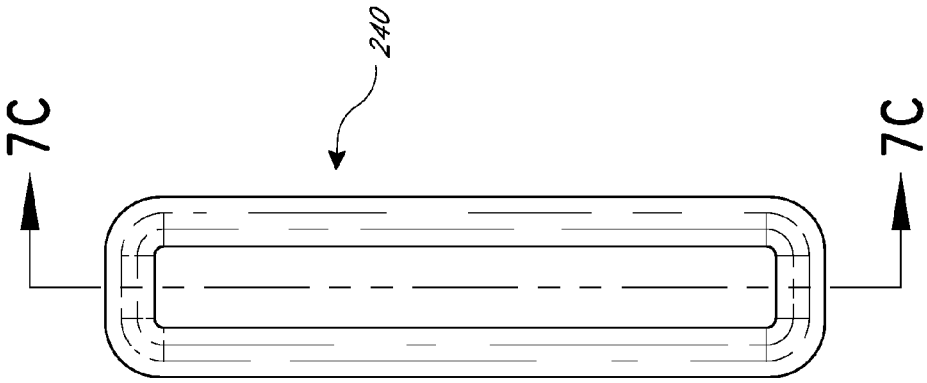
FIG. 7B is a front view of the back member of the waterproof inline controller shown in FIGS. 3 and 7A.
Figure 7A:
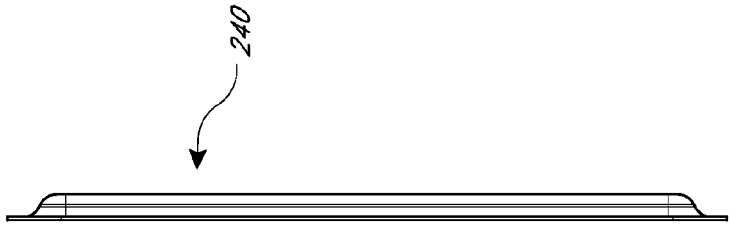
FIG. 7A is a side view of a back member of the waterproof inline controller shown in FIG. 3.
Figure 8:
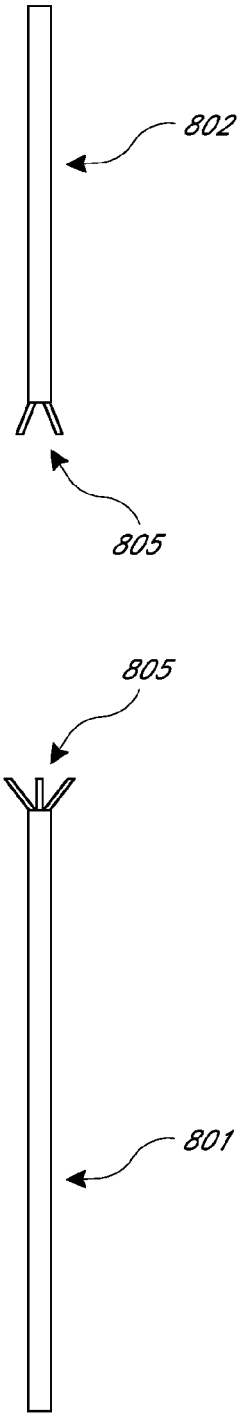
FIGS. 8-13 illustrate a method of making a waterproof inline controller according to one embodiment.

FIGS. 5A-5C illustrate the rigid frame 220. As shown, the rigid frame 220 includes a receiving space 280 sized to receive and snuggly house the remote. FIGS. 6A-6C illustrate the front cover 230 while FIGS. 7A-7C illustrate the back cover 240. The rigid frame, front cover, and back cover may be various sizes and shapes depending on the particular size and shape of the remote.

FIGS. 8-14 illustrate a method of making a waterproof inline controller according to one embodiment. The method can begin in FIG. 8 by providing a first cord 801 spaced apart from a second cord 802. The first cord 801 and second cord 802 can have one or more conductors 805. The conductors 805 can transmit and audio signal or other electronic signals to and from an electronic device, audio source, amplifier, and/or audio speaker. As shown, the first cord 801 has three conductors 805 while the second cord 802 has two conductors 805. The number of conductors 805 may vary depending on the application.

Figure 9:
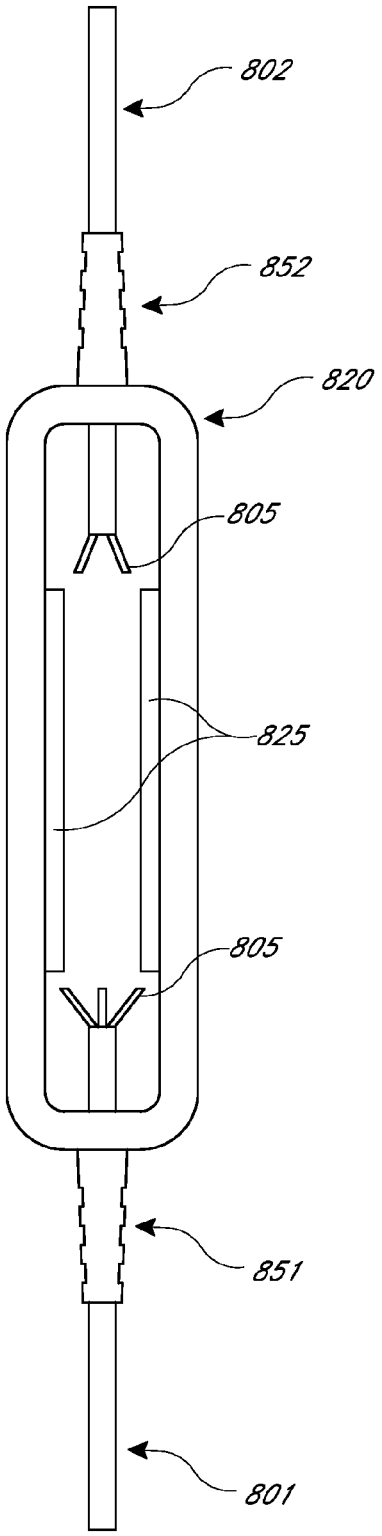

The method can continue in FIG. 9, by forming an overmold directly onto the first cord 801 and the second cord 802. The overmold may comprise shore 90A polyurethane. The overmold may be formed by injection molding or other techniques known in the art. The overmold can include a rigid frame 820 and cord covers 851 and 852. The rigid frame may include one or more internal ledges 825.

Figure 10:
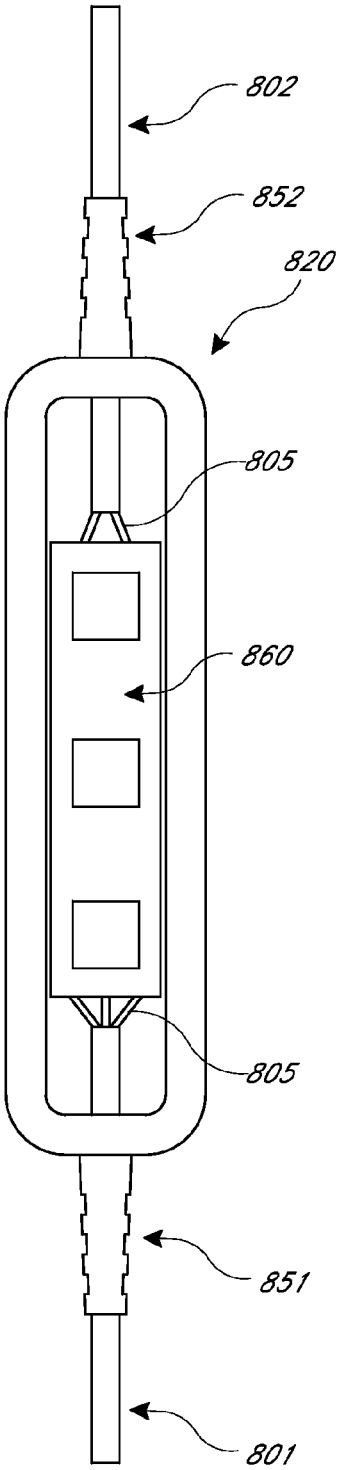
Figure 11:
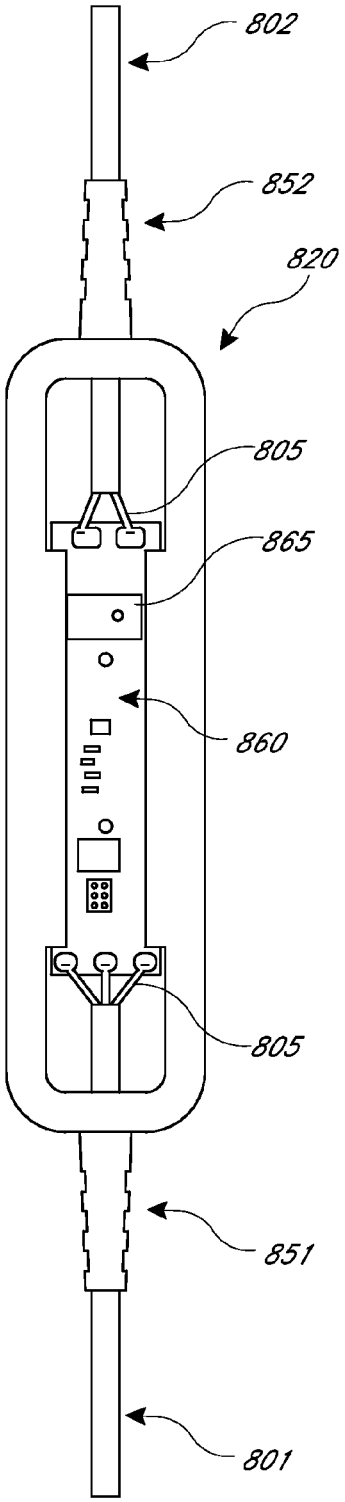

The method can continue in FIG. 10, by placing a remote 860 in the rigid frame 820. The remote 860 may be affixed to the internal ledges 825. The method can continue in FIG. 11 by soldering the conductors 805 to the remote 860. The remote 860 can include a MEMS microphone 865.

Figure 12:
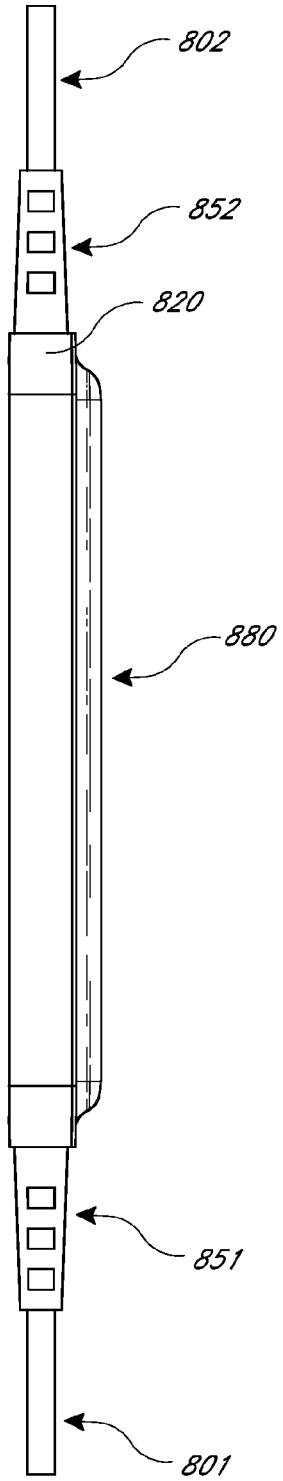
Figure 13:
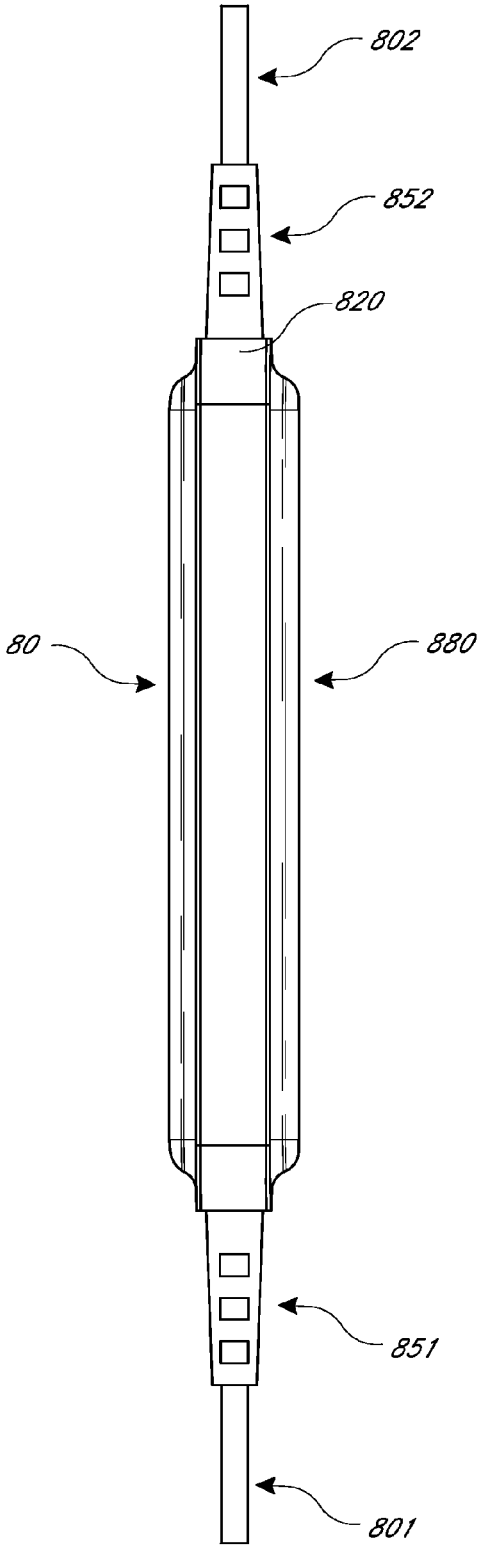
Figure 14:
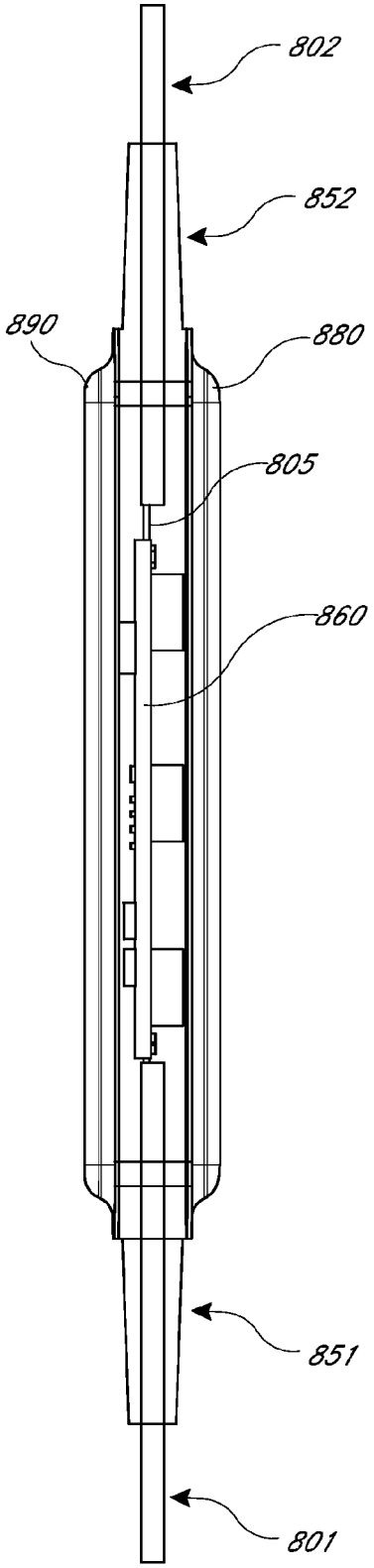
FIG. 14 is a cross-sectional view of the waterproof inline controller made accrding to the method shown in FIGS. 8-13.

The method can continue in FIGS. 12 and 13 by waterproofably sealing a front cover 880 and a back cover 890 to the outer ring of the rigid frame 820. The front cover 880 and a back cover 890 may comprise a 0.02 mm polyurethane film. FIG. 14 illustrates a cross-sectional view of the the finished waterproof in-line controller.

Figure 15A:
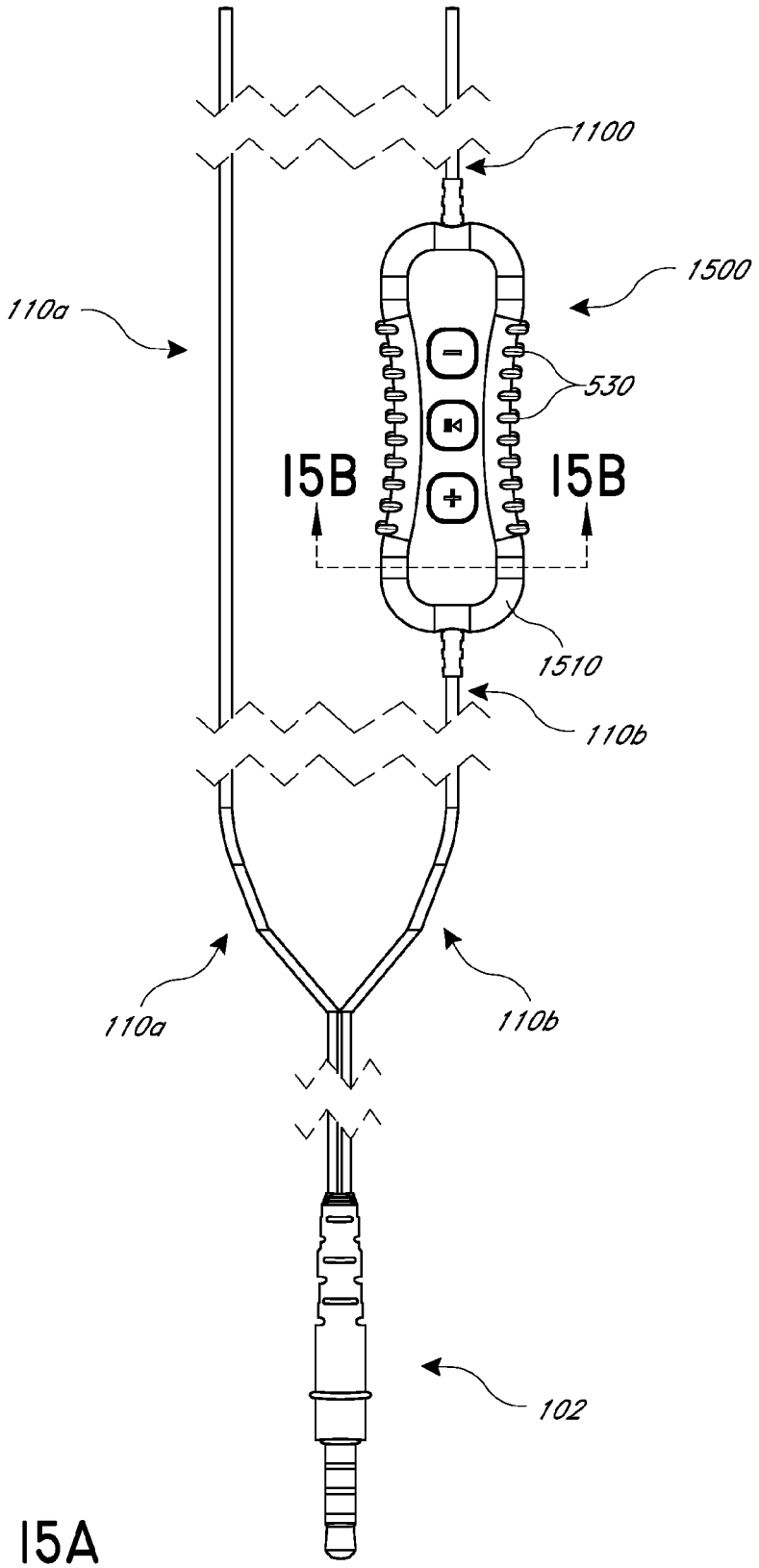
FIG. 15A is partial front view of the waterproof headset including a waterproof inline controller shown according to another embodiment.
Figure 15B:
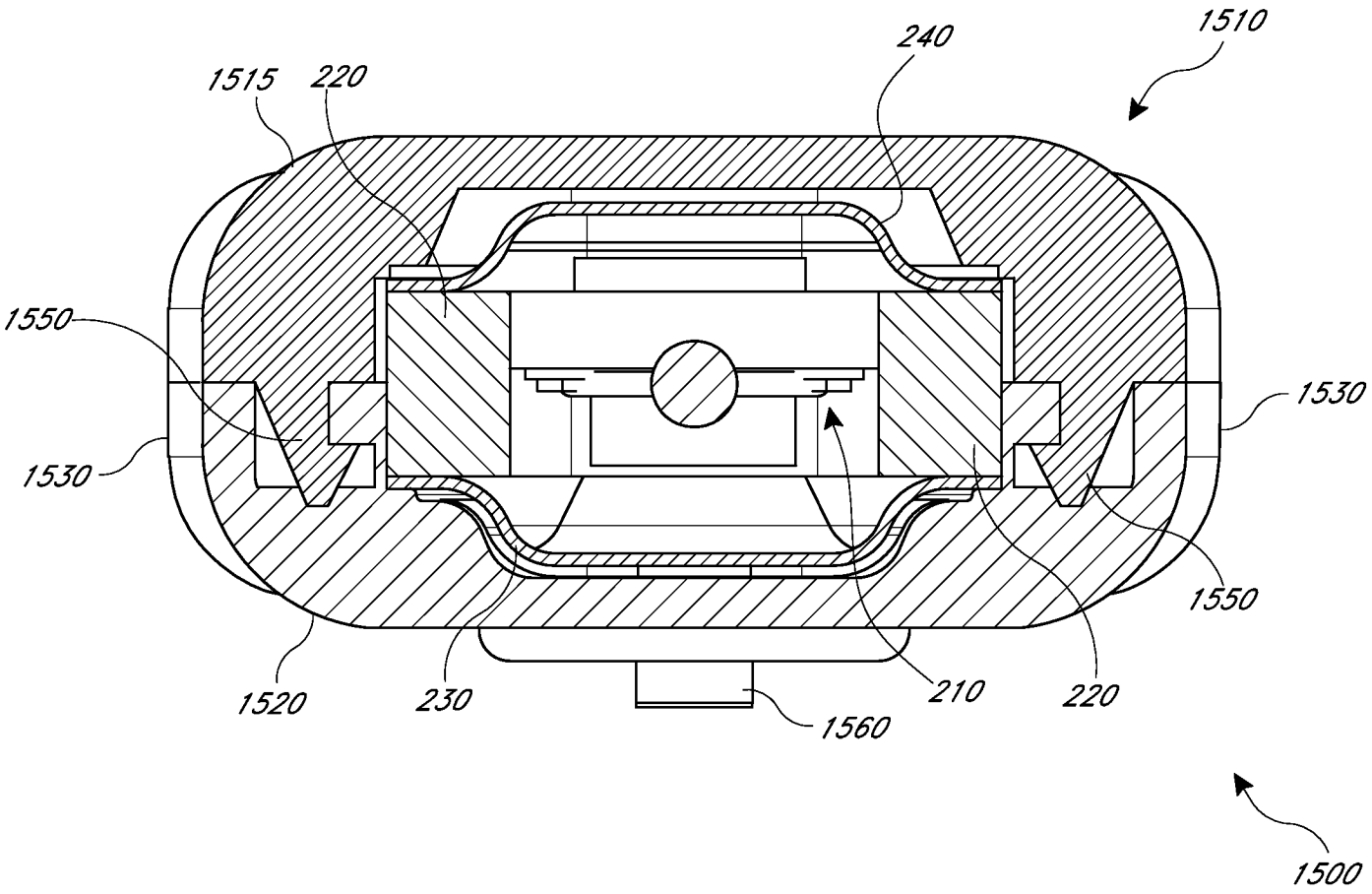
FIG. 15B is a cross-sectional view of the waterproof inline controller shown in FIG. 15A taken about the line 15B-15B.

FIG. 15A illustrates partial front view of the waterproof headset including a waterproof inline controller 1500 shown according to another embodiment. The embodiment shown in FIG. 15A is similar to the embodiments shown and described above and further includes a cover 1510. As shown in FIG. 15B, the cover may comprise a front cover 1520 and a back cover 1515 secured together by one or more latches 1550.

Figure 16:
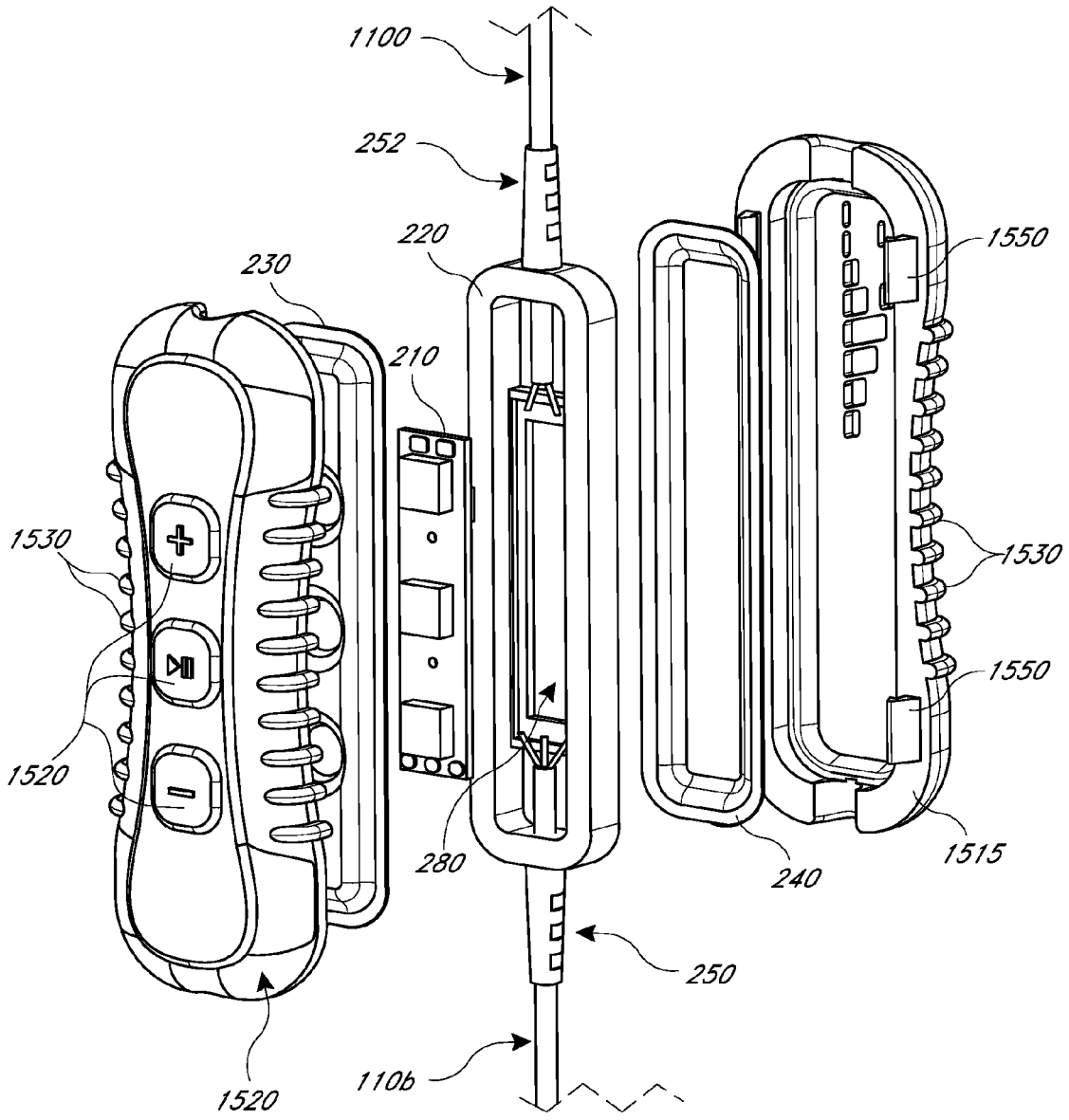
FIG. 16 is an exploded view of the waterproof inline controller shown in FIG. 15A.

Turning to FIG. 16, the exploded view illustrates that the front cover 1520 and back cover 1515 can be sized and shaped to surround and cover a remote 210 sealed within a rigid frame 220 by a front member 230 and a back member 240. The cover can protect the waterproof seals from environmental damage caused by, for example, sunlight or physical damages cause by, for example, drops and collisions. The cover may also include a plurality of ridges 1530 to allow for tactile recognition by a user. Similarly, the font cover 1520 may include one or more buttons 1560 having raised features to further enhance the tactile recognition of the buttons 1560 by a user. In other words, the raised features may allow for a user to operate the device without having to see the device.

Of course, it is to be understood that not necessarily all objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Furthermore, the skilled artisan will recognize the interchangeability of various features from different embodiments. For example, the features of the waterproof controllers disclosed in the various embodiments can be switched between embodiments. In addition to the variations described herein, other known equivalents for each feature can be mixed and matched by one of ordinary skill in this art to construct waterproof controllers in accordance with principles of the present invention.

Although this invention has been disclosed in the context of certain embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above.

What is claimed is:

1. Waterproof audio earphones comprising:

a connector configured to couple to a device that outputs an audio signal;

a waterproof controller operatively coupled to the connector with a first cord, the controller including a microphone and configured to control the operation of the device that outputs the audio signal;

at least one waterproof earphone operatively coupled to the connector; and a waterproof case enclosing the controller, wherein the case isolates the controller from the device and includes a plurality of buttons configured to be depressed by a user, the waterproof case comprising a flexible front member sealed to a rigid frame disposed around a perimeter of the controller, the flexible front member being configured such that sound may pass through the flexible front member without distortion.

2. The waterproof audio earphones of claim 1, further comprising a flexible back member waterproofably sealed to the rigid frame.

3. The waterproof audio earphones of claim 2, wherein the flexible front member comprises a polyurethane.

4. The waterproof audio earphones of claim 3, wherein each of the first cord and the second cord forms a waterproof seal with the rigid frame.

5. The waterproof audio earphones of claim 1, wherein the waterproof case further comprises a rigid outer shell enclosing the rigid frame and the flexible front member.

6. The waterproof audio earphones of claim 5, wherein the outer shell further comprises an outer shell around the rigid frame and the flexible front cover.

7. A waterproof audio controller comprising:

a waterproof compartment defined by a rigid frame having a proximal end, a distal end, and opposing sides, the rigid frame housing an audio controller;

a back member waterproofably sealed to a back side of the rigid frame;

a front member waterproofably sealed to a front side of the rigid frame, the front member including a plurality of buttons configured to be depressed by a user, the front member being configured such that sound may pass through the front member without interference;

a first cord waterproofably sealed to the proximal end and configured to conduct an electronic signal between the controller and an electronic device that outputs an audio signal; and a second cord waterproofably sealed to the distal end and configured to conduct an electronic signal between the controller and the electronic device that outputs an audio signal; and a cover disposed over and surrounding the rigid frame, the front member, and the back member.

8. The waterproof audio controller of claim 7, wherein the rigid frame comprises polyurethane having a hardness between 85A-95A.

9. The waterproof audio controller of claim 7, wherein the rigid frame further comprises a proximal overmold disposed on the proximal end and surrounding a portion of the first cord and a distal overmold disposed on the distal end and surrounding a portion of the second cord.

10. The waterproof audio controller of claim 7, wherein the rigid frame further comprises an inner frame disposed within the rigid frame and contacting the opposing sides of the rigid frame, the inner frame comprising a distal abutment surface and a proximal abutment surface configured to retain the controller within the inner frame.

11. The waterproof audio controller of claim 7, wherein the front member and back member comprise flexible membranes.

12. The waterproof audio controller of claim 7, wherein the flexible membranes comprise sheets of polyurethane.

13. The waterproof audio controller of claim 12, wherein the sheets of polyurethane have a thickness between 0.15 mm-0.25 mm.

14. The waterproof audio controller of claim 7, wherein the front member and back member are waterproofably sealed to the rigid frame by radio frequency welding.

15. The waterproof audio controller of claim 7, wherein the front member comprises a front surface and a back surface, the front surface comprising at least one recess configured to contact a top surface of the controller.

16. The waterproof audio controller of claim 7, a top cover and a bottom cover.

17. The waterproof audio controller of claim 16, further comprising a clasping mechanism to couple the top cover and the bottom cover together and surround the rigid frame.

18. The waterproof audio controller of claim 7, wherein the sides of the cover are concave.

19. The waterproof audio controller of claim 7, wherein the sides of the cover comprise a plurality of vertical ribs.

20. A method of making a waterproof audio controller comprising:

forming a compartment defined by a rigid frame around a first cord and a second cord, wherein the first cord is spaced apart from the second cord, the rigid frame having a proximal portion, a distal portion, and opposing side portions defining a receiving space having a front opening and a back opening, the first cord secured by the proximal portion of the rigid frame and the second cord secured by the distal portion of the rigid frame;

placing a controller within the cavity, the controller configured to control the operation of an electronic device;

placing a microphone configured to receive audible sound within the cavity; coupling the controller to the first cord and the second cord;

waterproofably sealing a front member over the front opening, the front member including a plurality of buttons configured to be depressed by a user, the front member being configured such that sound may pass through the front cover without distortion;

waterproofably sealing a back member over the back opening;

wherein the steps of waterproofablv sealing the front member over the front opening and waterproofably sealing the back member over the back opening waterproofably seals the compartment; and securing a rigid front cover to a rigid back cover, the front and back cover surrounding the rigid frame, the front member, and the back member.

21. The method of claim 20, wherein forming the rigid frame comprises forming a polyethylene frame directly over the first and second cords.

22. The method of claim 20, wherein waterproofably sealing comprises radio frequency welding a polyethylene sheet to the rigid frame.

* * * * *